United States Patent [19]

Bond, Jr.

[11] 4,015,535

[45] Apr. 5, 1977

[54] HYPERVELOCITY SPALLATORS

[75] Inventor: John W. Bond, Jr., Alexandria, Va.

[73] Assignee: The United States of America as represented by the Secretary of the Army, Washington, D.C.

[22] Filed: Oct. 22, 1976

[21] Appl. No.: 734,795

Related U.S. Application Data

[63] Continuation-in-part of Ser. No. 566,883, April 10, 1975, abandoned.

[52] U.S. Cl. ..... 102/92.3; 102/92.4; 102/105

[51] Int. Cl.[2] ..... F42B 11/26; F42B 13/00

[58] Field of Search ..... 102/52, 67, 92.1–92.6, 102/105

[56] References Cited

UNITED STATES PATENTS

| | | | |
|---|---|---|---|
| 3,026,806 | 3/1962 | Runton et al. | 102/105 |
| 3,212,208 | 10/1965 | Persechino et al. | 102/93 |
| 3,536,011 | 10/1970 | Kinnarid et al. | 102/105 |
| 3,749,016 | 7/1973 | Hershkowitz | 102/92.1 |
| 3,897,732 | 8/1975 | Atkins et al. | 102/92.3 |

*Primary Examiner*—Verlin R. Pendegrass
*Attorney, Agent, or Firm*—Nathan Edelberg

[57] ABSTRACT

The invention relates to hypervelocity projectiles of such mass, configuration, density and material that upon impact with targeted armor backface spallation occurs in which a large quantity of fragments are ejected from the backface although there has been no penetration of the projectile through the armor.

6 Claims, 1 Drawing Figure

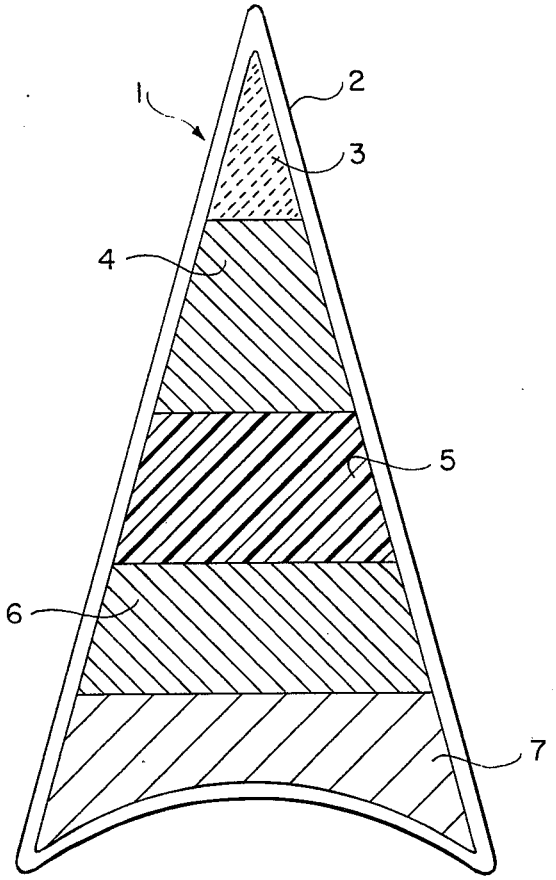
1
2
3
4
5
6
7

HYPERVELOCITY SPALLATORS

GOVERNMENT USE

The invention described herein may be manufactured, used and licensed by or for the Government for Governmental purposes without the payment to me of any royalties thereon.

HYPERVELOCITY SPALLATORS

This application is a continuation-in-part of Ser. No. 566,883, filed 10 Apr. 1975, and now abandoned.

BACKGROUND OF THE INVENTION

The present invention relates to hypervelocity spallators which have been the subject of investigations that have been conducted with the prime objective of developing enough information on hypervelocity impact shock-induced phenomena to enable and enhance the design of small projectiles (spallators) capable of optimizing backface spall and fragmentation in steel armor and other similar materials. The impact of a high velocity projectile upon a slab or armor results in a compressive stress pulse in the target that propagates away from the point of impact. This stress pulse contains most of the momentum carried by the projectile prior to the impact. When this compressive pulse encounters a free surface, it reflects and produces tension near the surface; if the cohesive strength of the material is exceeded, fracture occurs, and some or all of the momentum of the stress pulse is carried off in the resulting fragments of the material. This process of dynamic fracture by reflection of a compressive stress pulse at a free boundary is termed "spall", but should be distinguished from spall that occurs when an object passes completely through a target.

The character and depth of the spall are greatly influenced by the amplitude, shape and spatial width of the compressive stress pulse. These factors are, in turn, dependent upon the size, velocity, and composition of the projectile, and the material properties of the target. The term "spallator" herein means a projectile specifically designed to optimize impact induced backface spall from steel armor and other materials while the term "hypervelocity" implies impact velocities between three (3) and ten (10) km/sec.

Conceptually, a weapon system consisting of a warhead that could deliver a large number of projectiles at very high velocities would be an extremely effective method of defeating armored vehicles such as tanks and personnel carriers. Assuming that the projectiles could be adequately dispersed, the principal advantage of such a warhead would be the larger target area that could be covered with one warhead. Since the energy required to launch projectiles to a given velocity is a direct function of the projectile mass, twenty times as many 5-gram projectiles could be launched to a specific velocity as a single 100-gram projectile. Thus, for a given launcher weight and volume, a much larger area could be controlled by the use of a number of smaller projectiles. Furthermore, the hypervelocity projectiles would not be required to penetrate the armored vehicles since the lethality of the fragments spalled from the rear surface of the armor would be expected to neutralize the soft components inside the vehicle. For example, projectiles of 1 to 5 grams with velocities in the neighborhood of 10 km/sec would cause spallation on 1-inch armor plate currently in use.

The invention taught relates to the use of hypervelocity impact phenomena to inflict internal damage to armored vehicles without actually penetrating the armor which was the earlier anti-armor concept. Essentially, the damage mechanism consists of inducing extremely large pressure pulses in the armor by impact of a small hypervelocity projectile, or spallator. The stress wave propagates through the armor and throws off large numbers of lower velocity fragments from the backface, the phenomenon known as backface spallation. In general the spall fragments will have a total mass much larger than that of the spallator, and will be dispersed over a wide angle inside the vehicle. It is the damage caused by these armor spall fragments, rather than the original spallator impact, which comprises the lethal effect of the impact.

Existing anti-armor devices depend on penetration of the armor, and the technical tradeoffs associated with penetration are quite different from the tradeoffs for hypervelocity impact. Kinetic energy penetrators are high velocity projectiles launched from a large gun or warhead. By a combination of large mass and high strength, they are able to penetrate armor even at relatively low impact velocities of 0.7 to 1.5 km/sec. The size and costs of the required gun and projectile precludes their use in a wide area weapon system. Shaped charge penetrators use an explosive charge to generate a needle-shaped jet of metal weighing a few grams with velocities ranging from 7.5 km/sec at the tip to about 0.5 km/sec in the slug. Because of the jet configuration and velocity variation, a shaped charge must be used at a definite standoff distance, usually a few inches. Present information indicates that the threshold of spallation in armor plate using a small projectile traveling at hypervelocities to be approximately 4 to 6 km/sec, and accordingly, damage increases rapidly with velocity. Preliminary data indicates that projectiles with a mass of one gram are sufficient for producing spall fragments from 2.5 cm thick armor plate, and that the backface spall fragment mass is a very large multiple of the projectile mass. Present indications are that gram-sized projectiles impacting armor plate at velocities in excess of 7 km/sec are effective in immobilizing or delaying armored vehicles. It should, perhaps, be noted that comparable masses and velocities are to be found in the jets of existing shaped charges, although the damage mechanism is penetration rather than backface spallation.

In the course of the investigations pursued, different shaped spallators were studied, including solid and hollow spheres, cylinders (both solid and hollow) and cylinders with steel tips. In most cases where the projectiles were solid spheres, and backface spall resulted, the backface was ejected as a single plug. However, it was thought that a hollow sphere might cause backface spall at lower velocities than solid spheres of the same weight and it was thought that they might cause backface fragmentation. The reasoning behind these thoughts was that the impacting mass per unit area for the hollow sphere would be relatively small at the center which would cause the spall layer to form nearer to the backface than for a solid sphere; and the impacting mass per unit area would be large at the periphery, thus possibly resulting in an "irregular" compressive stress wave. The results of a few experiments support these hypotheses. These and further experiments and evaluations are described in U.S. Army Mobility Equipment Research and Development Center Reports 2067, 2174, and 2175, dated July 1973, April 1976, and April 1976 respectively, all of which are approved for public release.

As a result of the hollow sphere experiments, as well as other experiments, information was derived which enabled the design of spallators which were built for the purpose of optimizing backface fragmentation. These spallators were Lexan cylinders (Lexan is a polycarbonate resin) with impacting steel tips weighing 3.5 grams. On impacting 3-cm thick wrought steel, 90 grams of the backface fragmented into more than a dozen pieces which penetrated 0.20-cm thick aluminum witness plate. The spread in the eject angle was about 50° , which would have been hazardous to the soft components within a tank or armored vehicle.

If the spallators travel inside the atmosphere over distances greater than approximately 20 meters they must be aerodynamically configured with L/D ratios equal to 2, or greater. However, application in space aerodynamic configurations are not necessary, i.e., the spallators can be spheres or other shapes. If the target is armor, then to optimize backface spall and to satisfy aerodynamic and cost-effectiveness requirements, the diameter of the spallator should be equal to or with a factor of 3 less than the effective thickness of the armor.

This invention relates to an improved projectile or spallator weapon system for generating damaging backface spallation in a target wall surface of armor or other materials having a predetermined tensile strength, under hypervelocity conditions. The projectile is designed to produce a dynamic fracture (spallation) of the target wall surface opposite the surface of impact by transmittal of a compressive stress pulse within the target wall material which reflects in tension from the back target surface without the projectile penetrating through the target. The resultant intensity of the combined incident compressive stress wave and the reflected tensile wave must exceed the spall strength of said target material. The wave propagation is perpendicular to the front or impact surface of said target wall. In all cases the properties of the spallator materials relative to the target materials are important for optimizing spallation. Critically important are the density, p; the speed of sound through the particular material (which is indicative of the rate of propagation of the elastic stess wave in the material), c; the impedance, pc; and the material strength, particularly the tensile and spall strengths.

DESCRIPTION OF THE DRAWING

The FIGURE illustrates a preferred embodiment hypervelocity spallator constructed in accordance with the invention.

DESCRIPTION OF THE PREFERRED EMBODIMENT

Referring to the FIGURE, it can be seen that the preferred embodiment hypervelocity spallator 1 is shown as having a generally conical configuration for use within the earth's atmosphere. The L/D (Length-/Maximum Diameter) ratio for the configuration is 2, although it could be greater. The outer surface 2 of the spallator is a coating of ablative material designed to protect the inner components of the spallator against atmospheric heating. The tip 3, which is formed of pyrolytic graphite, is for the purpose of alleviating atmospheric ablation of the other segments. The secondary tip 4 is a medium or high density material such as an ESR steel which is used to defeat stand-off plates and layered targets.

The purpose of the layers 5–7 is to shape the stress wave that must be induced into the target upon impact in order to produce backface spallation of the target without penetration of the spallator therethrough. Upon impact, a forward moving shock or stress wave will be induced into the target armor and a backward moving stress wave will be induced into the projectile at the interface of segments 4 and 5. Part of the backward moving stress wave will reflect from the interface of segments 5 and 6 and enhance the fracture capabilities of the initial forward moving stress wave in the targeted armor. The remainder of the backward moving stress wave will continue backwards to the interface of segments 6 and 7 and again reflection and transmission will occur. By proper selection of materials, dimensions and geometry, the fracturing stress wave can be tailored to optimize fracture damage in the target. To optimize the stress wave, it is necessary that the materials selected for segments 5, 6, and 7 have an impedance factor *pc* (where *p* is the density and *c* is the velocity of sound through the specific material) such that the impedance of segment 5 is less than that of segment 6 which, in turn, is less than that of segment 7. An example of a suitable configuration of materials would be a nylon segment 5, brass layer 6, and steel layer 7. However, various other materials can be used, including liquids such as oils or water since no specific material is critical but, rather, it is the stress wave effect produced by the impedance mismatch that is important. It should be noted, however, that low density materials are preferable while high density materials (such as lead) and resilient materials (such as rubber) are undesirable. This is because resilient materials cause degradation of the impact shock waves which are the mechanism by which spallation occurs, and because the use of low density materials acts to prevent penetration of the spallator through the target, which is important to the optimization of shock wave formation.

What is claimed and desired to be secured by United States Letters Patent is:

1. A hypervelocity projectile means for producing backface spallation of armor plate, upon impacting said armor plate at velocities of at least 3 km/sec, to an extent of more than 20 times the mass of the projectile means without penetration of said projectile means through said armor plate comprising:

a. a body having a tip of ablation alleviating material;
b. a secondary tip of high density material located rearwardly adjacent to said tip of ablation alleviating material; and
c. at least two stress wave shaping segments positioned rearwardly of said secondary tip, said wave shaping segments having different impedance factors which increase in value from the frontmost shaping segment to the rearmost shaping segment.

2. The hypervelocity projectile of claim 1 wherein said body is generally conically shaped.

3. The hypervelocity projectile of claim 1 wherein there are three stress wave shaping segments and, wherein the first segment is formed of nylon, the second segment is formed of brass and the third segment is formed of steel.

4. The hypervelocity projectile of claim 1 wherein at least one of said segments is formed of a liquid material.

5. The hypervelocity projectile of Claim 3 wherein one said liquid material is water.

6. The hypervelocity projectile of claim 3 wherein one said liquid material is an oil.

* * * * *